United States Patent [19]

Blanchard et al.

[11] Patent Number: 5,029,739

[45] Date of Patent: Jul. 9, 1991

[54] TWO PIECE GARMENT HANGER WITH LOCKING CONNECTION

[75] Inventors: Russell O. Blanchard, Zeeland; Judd F. Garrison, Grand Rapids; Thomas H. Van Langevelde, Zeeland, all of Mich.

[73] Assignee: Batts, Inc., Zeeland, Mich.

[21] Appl. No.: 496,243

[22] Filed: Mar. 20, 1990

[51] Int. Cl.[5] ..... A47G 25/18; A47G 25/16; A47G 25/14

[52] U.S. Cl. ..... 223/88; 223/85; 223/DIG. 4

[58] Field of Search ..... 223/85, 88, 92, 95, 223/DIG. 2, DIG. 3, DIG. 4; 211/113; D6/315, 328

[56] References Cited

U.S. PATENT DOCUMENTS

| | | | |
|---|---|---|---|
| 2,391,661 | 12/1945 | Watkins et al. | 223/88 |
| 2,498,400 | 2/1950 | Du Lude | 223/88 |
| 4,438,874 | 3/1984 | Zuckerman et al. | 223/91 |
| 4,653,678 | 3/1987 | Blanchard et al. | 223/85 |
| 4,871,098 | 10/1989 | Bredeweg et al. | 223/85 |

OTHER PUBLICATIONS

WO 84/02836 PCT Publication; Feldinger, 8-1984.
EP 0144653 EPO Publication; Kotowski; 6-1985.

*Primary Examiner*—Werner H. Schroeder
*Assistant Examiner*—Bibhu Mohanty
*Attorney, Agent, or Firm*—James G. Staples

[57] ABSTRACT

A drop loop hanger for maintaining two piece garments in a stable and attractive condition for retail customers includes clip means formed either integrally with the drop loop or as a separate member and, by virtue of the inherent resiliency of the clip means and a multi-point support on either side of the vertical shank of the drop loop, stabilizes the drop loop with respect to the hook hanger.

12 Claims, 2 Drawing Sheets

Fig. 7.
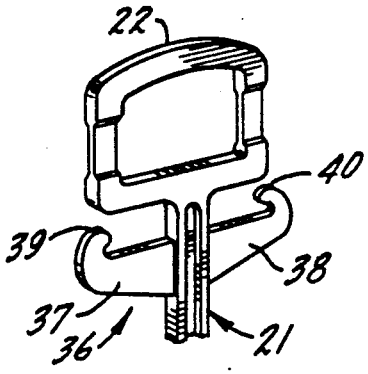
Fig. 8.
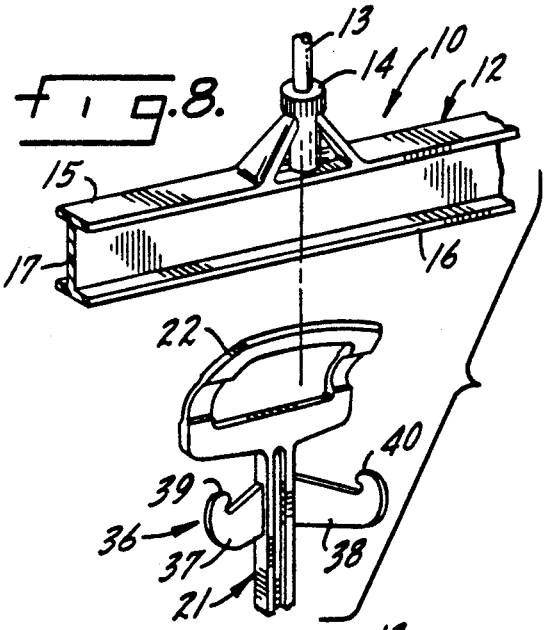
Fig. 10.
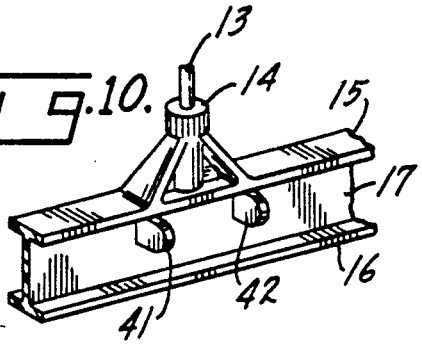
Fig. 9.
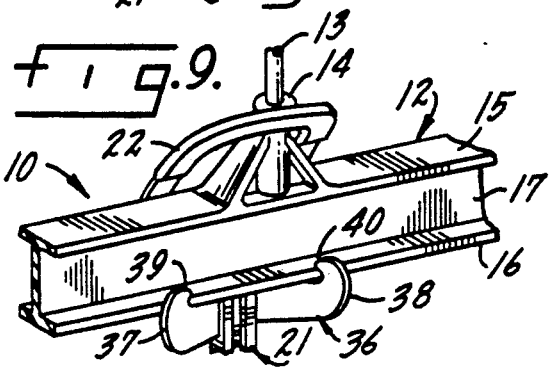
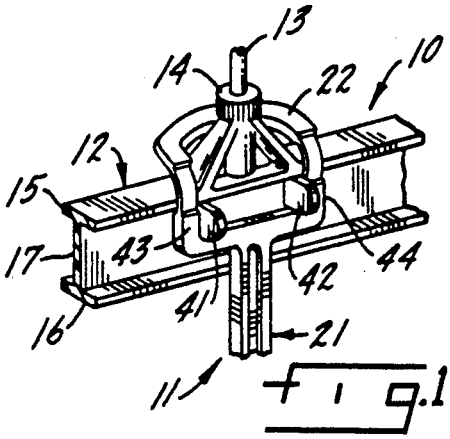
Fig. 11.

TWO PIECE GARMENT HANGER WITH LOCKING CONNECTION

FIELD OF THE INVENTION

This invention relates generally to display hangers and particularly to drop loop type hangers which must present two piece garments, such as swimsuits, in a stable and attractive manner to retail customers.

BACKGROUND OF THE INVENTION

Multi-part garments, such as two piece swimsuits, are difficult to present in an attractive, eye-pleasing fashion to the retail customer. One form of garment hanger that has been developed to display such garments comprises two pieces, namely, a conventional upper garment hanger and a lower, drop loop hanger. The drop loop hanger usually includes a loop, generally flexible, from which a downwardly extending vertical spacer rod extends, the spacer rod terminating at its lower end portion in a generally horizontally disposed cross bar. The drop loop hanger cross bar is thereby spaced a desired vertical distance below the cross bar of the upper hanger so that the two pieces of the garment are separated, one from the other, when attached to the garment hanger. Each of the cross bars has suitable means, such as a clip for suspending and displaying one piece of a two piece garment at each end of each cross bar.

While such a compound hanger serves the basic function of displaying both pieces of a two piece garment in spaced relationship to one another, the overall appearance to the customer is often somewhat unattractive because the drop loop hanger has a tendency to swing about its point of support on the upper cross bar like a pendulum. Further, often the customer is not able to obtain a good view of a racked garment when the top cross bar is tilted by the customer in an attempt to swing the garment out away from similar garments located on either side of it. The adjacent garments, particularly when a rack of such garments is quite crowded, tend to hold the lower garment and the drop loop hanger in its normal vertical position by reason of the restraining forces exerted by the adjacent garments on the drop loop garment. As a consequence, the lower piece of the two piece garment is not brought out into the open where the customer may view it.

Even when the customer removes the garment from the rack a poor presentation often results because the lower drop loop hanger flops about as the customer holds the garment up and attempts to view it from different angles while contemplating purchase.

In addition to the above described customer related deficiencies inherent in current drop loop type hangers, loading of the garment on such a hanger is more difficult than it should be due to the free swinging action of the drop loop hanger. Retail store personnel for example are often required to load a large number of two piece garments on such hangers in a relatively short period of time, as when a new shipment of such garments are received at a retail store. The loading task can be fatiguing and frustrating, both for the retail store personnel who load the hangers at the retail store and, also, for the factory personnel who load the hangers prior to shipment in those instances where the garments are shipped in a hung condition.

The above described problems cannot be avoided by simply making the upper and lower hangers of a structurally integral construction since, particularly at the retail level, the hangers must be disassembled for seasonal use; specifically, the drop loop hanger which displays a two piece swimsuit in June may be required to display a pair of heavy wool slacks in November, at which time the drop loop hanger would be a nuisance. Hence, to accommodate the possibility of all season use, the hanger components must be separable, one from another.

BRIEF DESCRIPTION OF THE INVENTION

The garment hanger of this invention is a separable, two piece hanger capable of suspending and displaying one or two piece garments in a visually pleasing manner. The hanger may be loaded and unloaded in less time and with less effort than current drop loop hangers. These attributes flow from the use of securement means which fix the relative positions of the upper hanger and the drop loop hanger one to another upon assembly without (i) regard to the movements imparted to the entire assembly during assembly at the factory or retail store, (ii) the loading of garments onto the hangers at either locale, or (iii) the forces which are imparted to the hanger and its suspended garment during use, such as manipulation of the hangers and the garment it displays by a retail customer, and removal of multi-piece garments from the hanger. The securement means can be formed integrally with the drop loop hanger and be formed for gripping connection to the upper hanger, or as a third piece which is assembled to both the upper hanger and the drop loop hanger. Whether the securement means is formed integrally with a hanger or as a separate piece, the assembly process can be carried out, with minimal training, with one hand by an assembler. Either one or both pieces of a two piece garment initially suspended from the hanger can be removed from the hanger without destroying the structural rigidity of the assembly whereby the hanger is ready, without preparation, to receive another one or two piece garment. Preferably the securement means is formed from a conventional flexible plastic material used in this type of product so that the securement means is capable of a nearly unlimited number of loadings and unloadings, and additional flexings, with no deterioration in structural integrity.

BRIEF DESCRIPTION OF THE DRAWINGS

The invention is illustrated more or less diagrammatically in the accompanying drawing wherein:

FIG. 7 is a perspective view of the upper end portion of the drop loop hanger of another embodiment of the garment hanger of this invention;

FIG. 8 is an exploded perspective view of the assembly of the upper end portion of the drop loop hanger of FIG. 7 to the upper hanger;

FIG. 9 is a perspective view of the structure of FIG. 8 in an assembled condition;

FIG. 10 is a perspective view of the central portion of the cross bar of the upper hanger of yet another embodiment of the invention; and FIG. 11 is a perspective view of the embodiment of FIG. 10 in an assembled condition.

Like reference numerals will be used to refer to like parts from Figure to Figure in the drawing.

DETAILED DESCRIPTION OF THE INVENTION

Figure 1:
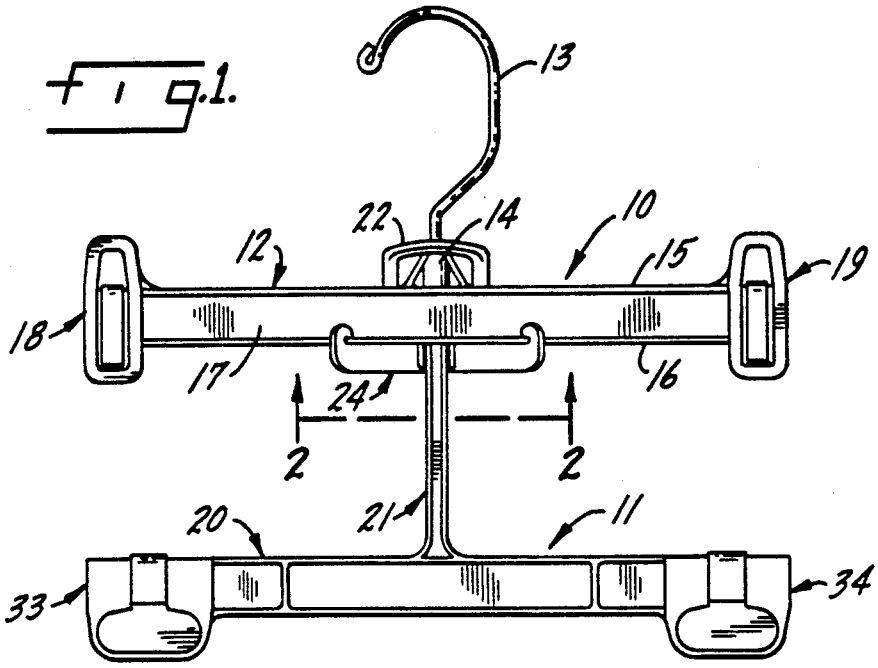
FIG. 1 is a front elevation of a separable, multi-part garment hanger of the invention.
Figure 2:
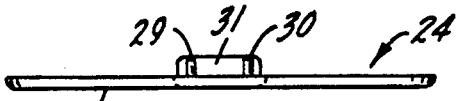
FIG. 2 is a view of a portion of the clip component of the securement means taken substantially along the line 2—2 of FIG. 1 in an as-manufactured, non-activated condition.
Figure 3:
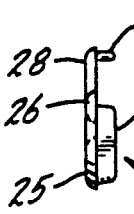
FIG. 3 is an end view of the portion of the clip component shown in FIG. 2 in the same condition.

Referring first to FIGS. 1–6 and initially to FIG. 1, a garment hanger known generally as a drop loop type hanger is shown in assembled condition in FIG. 1. An upper hanger is indicated generally at 10 and a lower drop loop type hanger is indicated generally at 11. The upper hanger 10 includes a generally horizontally oriented cross bar which is indicated generally at 12 and a hook 13. Hook 13 is received in a boss 14 which projects above the cross bar 12 and may be fixed or securable with respect thereto as desired. The upper cross bar 12 includes an upper flange 15, a lower flange 16, and a web 17 which connects flanges 15 and 16. Garment suspending means located at each end of the upper cross bar 12 are indicated generally at 18 and 19. In this instance, clamp type suspending means have been shown, but since the specific type of garment suspending means may be of different construction they are not described in detail.

Figure 6:
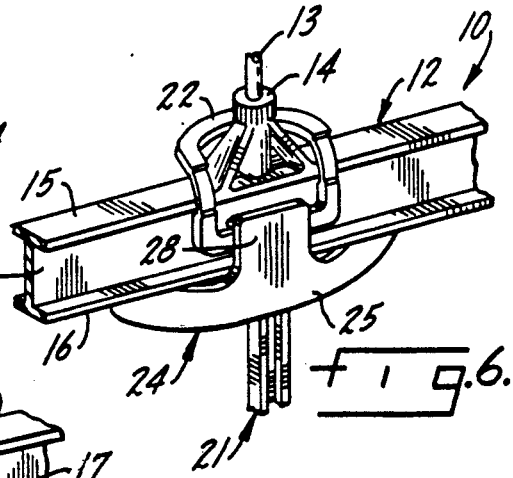
FIG. 6 is a view similar to FIG. 5 from the other side of the garment hanger of this invention.
Figure 5:
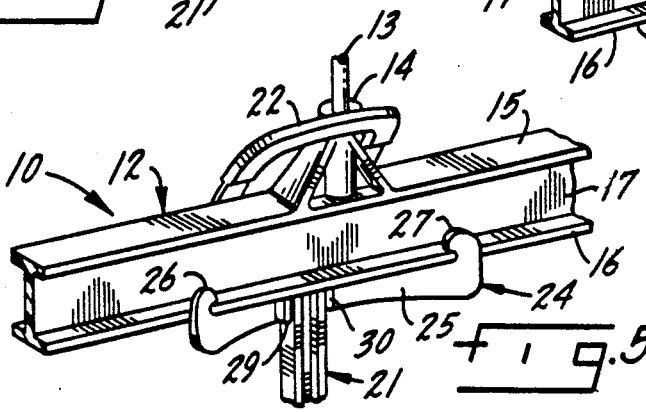
FIG. 5 is a front perspective of the lower central portion of the upper hanger and the upper end portion of the drop loop hanger with the securement means in an activated condition.

The drop loop hanger 11 includes a generally horizontally oriented cross bar indicated generally at 20, and a generally vertically upperwardly extending shaft member indicated generally at 21, the drop loop hanger terminating at its upper end portion in a loop 22 which, as best seen in FIGS. 5 and 6, is sufficiently flexible and deformable to be threaded over the hook 13 while maintaining the shaft 21 vertical.

Figure 4:
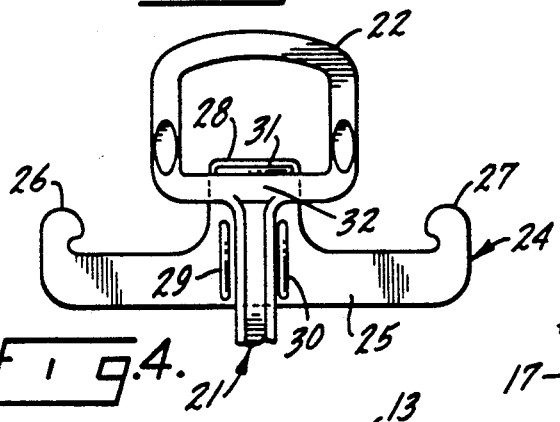
FIG. 4 is front view of the upper end portion of the drop loop hanger and the clip illustrated in FIGS. 2 and 3 in a pre-final assembled condition.

A securement member or clip is indicated generally at 24. The clip has a horizontal body section 25 which terminates at its ends in inward facing hooks 26 and 27. A centrally located upperwardly extending projection is indicated at 28. Two vertical raised bars are indicated at 29, 30, the two bars being spaced apart a distance sufficient to receive the shaft 21 in snug, or nearly snug, relationship as best seen in FIG. 4. A third horizontally positioned raised bar is shown at 31, bar 31 being located on the projection 28 and above the upper ends of vertical bars 29, 30 a distance sufficient to snugly, or nearly snugly, receive the lower bar 32 of the loop 22.

Garment suspending means located at the ends of the cross bar 20 are indicated generally 33 and 34. In this instance clamp type suspending means well adapted to hold, for example, one piece of a two piece bathing suit have been shown, but since the specific type of suspending means may be of different constructions they are not described in detail.

Referring now to FIGS. 7–9, a drop loop hanger is indicated generally at 36. The upper end of the shaft 21 terminates in a loop 22 which may be identical in construction to the loop in the embodiment of FIGS. 1–6, though it need not be. In this embodiment a pair of hooks 37, 38 extend generally horizontally outwardly from each side of shaft 21, one on each side as shown best on FIG. 7. Each hook terminates in an inwardly directed lip 39, 40 respectively. As best seen from FIG. 9 the vertical distance between the under side of lip 39 or 40 and the top of the shank portion of its associated hook is sufficient to snugly, or near snugly, receive and fit over the lower flange 16 of upper cross bar 12.

In the embodiment of FIGS. 10 and 11 a pair of ears 41, 42 project outwardly from web 17. Preferably the ears have a vertical height sufficient to prevent the loop 22 10 from moving upwardly or downwardly after the drop loop hanger 11 is assembled to the upper hanger 10 as shown in FIG. 11; that is, with the flexible drop loop 22 flexed around, and in abutting engagement with, the side of the boss 14 which is located on the opposite side of the web from the ears 4!, 42. In the same way, the ears 41, 42 are spaced horizontally a distance sufficient to form a snug, or nearly snug, fit with the inside vertical sides 43, 44 of the loop 22.

From the foregoing it will be seen that the garment hanger in each of its forms enables two piece garments, such as swimsuits, to be attractively displayed. Further, the hanger in all of its forms is suitable for all season use in that the drop loop hanger portion may be easily detached to thereby permit the upper hanger to be used to display a wide variety of single piece garments as the season demands, yet it can be quickly and easily converted to display two piece garments in response to season changes or other requirements. The garment hanger assembly can be readily molded from conventional plastic materials which have been heretofore used in this type of hanger. After minimal familiarity with the hanger, retail and manufacturing personnel will be able to assemble and disassemble the hanger with ease.

Although a preferred embodiment of the invention has been illustrated and described it will be obvious to those skilled in the art that modifications and improvements can be made within the scope of the invention. Accordingly, the invention is not intended to be limited to the foregoing description which is exemplary, but only by the scope of the hereafter appended claims when interpreted in light of the relevant prior art.

We claim:

1. A garment hanger assembly, said hanger assembly including a first garment hanger having a hook and a cross bar means, said hook extending upwardly from a central area of said cross bar means for suspending the assembly from a support location, a second garment hanger, said second garment hanger being a drop loop hanger having a cross bar means and shaft means extending generally upwardly from the second hanger cross bar means, said shaft means terminating, at its upper end portion, in a loop capable of being placed over and removed from the first garment hanger hook to thereby assemble and disassemble the second hanger from the first garment hanger, and securement means for maintaining the second hanger and the first garment hanger in fixed relationship to one another in both loaded and unloaded conditions whereby a single or multi-piece garment can be secured to the hanger assembly.

2. The garment hanger assembly of claim 1 wherein the securement means includes first gripping means carried by the second hanger and second gripping means carried by the first hanger, said first and second gripping means, when in engagement with one another, securing the second hanger to the first hanger snugly, as desired.

3. The garment hanger assembly of claim 2 wherein the first gripping means carried by the second hanger includes flexible hook means which, following threading of the drop loop over the hanger hook, may be flexed to cause said flexible hook means to lock to the cross bar means of the first hanger.

4. The garment hanger assembly of claim 3 wherein the first gripping means is carried by the second hanger shaft.

5. The garment hanger assembly of claim 4 wherein the first gripping means comprises two hook arms, one extending outwardly away from said drop loop shaft in opposite directions.

6. The garment hanger assembly of claim 4 wherein the first gripping means is structurally integral with the second hanger shaft.

7. The garment hanger assembly of claim 2 wherein the second gripping means carried by the hook hanger includes a first pair of abutment surfaces formed on projection means which extend outwardly from the cross bar means of the first hanger, said pair of abutment surfaces being located a given distance apart, and the first gripping means on the second hanger including opposed, generally vertically oriented inside surface portions of the drop loop, said drop loop surface portions being spaced from one another a distance substantially equal to, but no more than slightly greater than, the aforementioned given distance defined by the pair of abutment surfaces of the second gripping means on the first hanger.

8. The garment hanger assembly of claim 7 wherein the projection means includes a pair of projecting members which extend outwardly from the first hanger cross bar means towards the lower inner portion of the drop loop.

9. The garment hanger assembly of claim 7 wherein the second gripping means carried by the first hanger includes a second pair of abutment surfaces formed on the projection means, and the first gripping means on the second hanger includes generally horizontally oriented inside surface portions of the drop loop, said second pair of abutment surfaces on the projection means engaging the generally horizontally oriented inside surface portion of the drop loop snugly, or nearly snugly, whereby when the drop loop is threaded over the first hanger and rests in engagement with a lower end portion of the hook means.

10. The garment hanger assembly of claim 1 wherein the securement means includes clip means which is attachable and detachable from the first hanger and second hanger.

11. The garment hanger assembly of claim 10 wherein the clip means includes a base having a projection means which includes a generally downwardly facing abutment surface and two generally vertically oriented facing abutment surfaces arranged to snugly, receive the drop loop shaft therebetween in an assembled condition, said first, generally downwardly facing abutment surface being arranged to make abutting contact with the upper, inner surface portion of the bottom side of the drop loop, and hook means for connecting the base of the clip means to the first hanger cross bar means.

12. The garment hanger assembly of claim 11 wherein the projection means comprises three raised portions, the first raised portion having a generally downwardly facing abutment surface located within the drop loop, and the second and third raised portions being located outside and beneath the drop loop in assembled condition.

* * * * *